US009644651B2

(12) United States Patent
Tho et al.

(10) Patent No.: US 9,644,651 B2
(45) Date of Patent: May 9, 2017

(54) METHOD FOR CONTROLLING HYDRAULIC SYSTEM OF CONSTRUCTION MACHINERY

(71) Applicant: Doosan Infracore Co., Ltd., Incheon (KR)

(72) Inventors: Yong Ho Tho, Seoul (KR); Woo Yong Jung, Seoul (KR)

(73) Assignee: Doosan Infracore Co., Ltd., Incheon (KR)

( * ) Notice: Subject to any disclaimer, the term of this patent is extended or adjusted under 35 U.S.C. 154(b) by 0 days.

(21) Appl. No.: 14/778,212

(22) PCT Filed: Mar. 21, 2014

(86) PCT No.: PCT/KR2014/002381

§ 371 (c)(1),
(2) Date: Sep. 18, 2015

(87) PCT Pub. No.: WO2014/148855

PCT Pub. Date: Sep. 25, 2014

(65) Prior Publication Data

US 2016/0061236 A1 Mar. 3, 2016

(30) Foreign Application Priority Data

Mar. 21, 2013 (KR) ..... 10-2013-0030442

(51) Int. Cl.

| | |
|---|---|
| ***F15B 21/08*** | (2006.01) |
| ***F15B 11/04*** | (2006.01) |
| ***F02D 29/04*** | (2006.01) |
| ***E02F 9/22*** | (2006.01) |
| ***F04B 49/06*** | (2006.01) |

(52) U.S. Cl.

CPC ..... *F15B 21/087* (2013.01); *E02F 9/2221* (2013.01); *E02F 9/2235* (2013.01);
(Continued)

(58) Field of Classification Search

CPC ..... F15B 21/08; F15B 21/087; F15B 11/04; F15B 2211/20523; F15B 2211/20546;
(Continued)

(56) References Cited

U.S. PATENT DOCUMENTS 6,098,322 A * 8/2000 Tozawa ..... E02F 3/437 37/414
6,672,055 B1 * 1/2004 Konishi ..... E02F 9/2235 60/449

(Continued)

FOREIGN PATENT DOCUMENTS

JP 2007-290607 11/2007
JP 2012-057347 3/2012

(Continued)

OTHER PUBLICATIONS

International Search Report for International Patent Application PCT/KR2014/002381 mailed Jun. 16, 2014. 4 pages.

*Primary Examiner* — Krishnan Ramesh
(74) *Attorney, Agent, or Firm* — K&L Gates LLP

(57) ABSTRACT

The method for controlling the hydraulic system of construction machinery according to the present disclosure includes an engine speed prediction step, in which a variable rated engine speed, which varies within a range larger than a fixed rated engine speed and smaller than a high idle engine speed for the fixed rated engine speed and a virtual engine speed, which is to be input later, are predicted to output a virtual engine speed value predicted before an actual engine speed is input. Accordingly, when an operation load is applied, pump torque may initially have a margin, and even though an engine speed is decreased due to the operation load, it is possible to prevent an engine speed decrease phenomenon in which the engine speed becomes remarkably smaller than the rated engine speed.

9 Claims, 18 Drawing Sheets

(52) U.S. Cl.
CPC ..... *E02F 9/2246* (2013.01); *E02F 9/2292* (2013.01); *E02F 9/2296* (2013.01); *F02D 29/04* (2013.01); *F04B 49/065* (2013.01); *F15B 11/04* (2013.01); *F15B 2211/20523* (2013.01); *F15B 2211/20546* (2013.01); *F15B 2211/6651* (2013.01); *F15B 2211/6655* (2013.01); *F15B 2211/6656* (2013.01); *F15B 2211/88* (2013.01)

(58) Field of Classification Search
CPC ..... F15B 2211/6651; F15B 2211/6655; F15B 2211/6656; E02F 9/22; E02F 9/2221; E02F 9/2235; E02F 9/2246; E02F 9/2292; E02F 9/2296; F02D 29/04; F04B 49/065
USPC ..... 60/372; 701/50
See application file for complete search history.

(56) References Cited

U.S. PATENT DOCUMENTS 7,469,535 B2 * 12/2008 Sawada ..... E02F 9/2235 60/431
8,720,629 B2 * 5/2014 Sohn ..... E02F 9/2066 180/170
9,382,694 B2 * 7/2016 Kim ..... B60W 30/1888
2003/0116130 A1 * 6/2003 Kisaka ..... F02D 37/02 123/406.45
2006/0235595 A1 * 10/2006 Sawada ..... E02F 9/2235 701/50
2012/0251332 A1 * 10/2012 Sohn ..... E02F 9/2066 417/34
2015/0176252 A1 * 6/2015 Kim ..... B60W 30/1888 701/50
2016/0003265 A1 * 1/2016 Joung ..... F15B 11/0423 60/328
2016/0047399 A1 * 2/2016 Kim ..... E02F 9/2235 60/327

FOREIGN PATENT DOCUMENTS

KR 10-2011-0012036 2/2011
KR 10-2012-0023770 3/2012

* cited by examiner

ENGINE HORSEPOWER VARIABLE DISTRIBUTION
ps1:ps2 = x%:(100-x)%
HEREIN, X IS DISTRIBUTION RATIO OF PS1

METHOD FOR CONTROLLING HYDRAULIC SYSTEM OF CONSTRUCTION MACHINERY

CROSS REFERENCE TO RELATED APPLICATIONS

The present application is a National Stage of International Application No. PCT/KR2014/002381, filed on Mar. 21, 2014, which claims priority to Korean Patent Application No. 10-2013-0030442, filed on Mar. 21, 2013, the entire contents of each of which are being incorporated herein by reference.

FIELD OF THE DISCLOSURE

The present disclosure relates to a method for controlling a hydraulic system of construction machinery, and more particularly, to a method for controlling a hydraulic system of construction machinery, which is capable of controlling a hydraulic system by applying a variable rated speed according to a dynamic characteristic of an engine.

BACKGROUND OF THE DISCLOSURE

In general, construction machinery includes a hydraulic system. The hydraulic system receives power from an engine. The hydraulic system includes a hydraulic pump, a main control valve, an actuator, and an operating unit (a joystick and the like).

The hydraulic pump is driven by power of the engine to discharge working oil in which pressure is formed. The main control valve distributes and provides working oil to a desired actuator among a plurality of actuators. The actuator performs a desired operation by operating a corresponding working device by using working oil.

The engine generates power while consuming fuel. Torque of the engine implemented at specific engine speed (rpm) is changed. This will be described with reference to FIG. 1.

As illustrated in FIG. 1, when an engine speed is excessively high or low, torque of the engine is rather decreased, which may deteriorate energy efficiency. Further, when an engine speed is high, fuel consumption is increased. That is, the engine needs to be operated at an appropriate engine speed considering energy efficiency, and in this case, fuel efficiency may increase.

A rated engine speed is suggested to the engine. When an engine speed is lower than the rated engine speed, actually implemented torque is low, so that an engine stall phenomenon may occur when a larger load than the torque generated in the engine is applied. Particularly, when a large load is suddenly applied to the hydraulic system, the engine speed may sharply drop.

A load applied to the hydraulic system is increased/decreased in proportion to an operation displacement of the operating unit. Examples of the operating unit include a joystick and a pedal. Hereinafter, the operating unit will be described based on a joystick as an example.

A sharp operation of the joystick by an operator means a sharp increase of required torque. The increase of torque means that a discharged flow rate of working oil is increased or pressure of working oil is increased. In order to increase torque, when a discharged flow rate of working oil is uniformly maintained, pressure of the working oil needs to be increased. The increase of the pressure of the working oil means that a load is applied to the hydraulic pump, and the load applied to the hydraulic pump is applied to the engine as a load.

Horsepower control by a negative control manner (or referred to as "negacon") known in the related art changes secondary pressure of a pilot pump by adjusting a current value supplied to an electronic proportional pressure reducing (EPPR) valve attached to the pump, and controls horsepower set in the pump. To this end, a vehicle control device determines a current value by proportional derivative (PD) control or offset control so that a fixed rated engine speed is maintained by setting an engine speed by a dial in advance.

Further, the rated engine speed is to set to a level of 100 rpm in a high idle state so that the pump may use maximum horsepower. The rated engine speed is designed so as to maximally utilize horsepower of the pump, but there are many cases where it is impossible to use full horsepower by the dynamic characteristic of the engine, so that tuning of the rated engine speed is limited. Further, fuel is unnecessarily consumed and exhaust gas and the like are generated due to a gap between an engine speed when the operator sharply operates the joystick and the rated engine speed.

A problem occurring when the operator sharply operates the joystick will be described with reference to FIG. 2. As illustrated in FIG. 2, the joystick is sharply operated at a specific moment, so that an engine speed is sharply decreased from a time point t1 requiring large torque, and the engine speed is decreased to be lower than a rated engine speed at a specific moment t2. Then, a turbocharger is operated, and a time is taken until the turbocharger exhibits a normal function. As described, when the function of the turbocharger is normally performed, the engine speed is gradually restored.

The engine speed may be more severely decreased when the dynamic characteristic of the engine is changed, and even in this case, the engine consumes the larger amount of fuel in order to implement required torque. That is, the consumption of the large amount of fuel means that fuel efficiency extremely deteriorates, and causes exhaust gas.

Particularly, the hydraulic system known in the related art corrects a rated engine speed by setting a dynamic characteristic and a characteristic of a torque curve of the engine by constants and collectively reflecting the constants, but there is a limit in correction work, and thus there is a problem in that the dynamic characteristic of the engine fails to be properly reflected.

SUMMARY

An embodiment of the present disclosure is conceived so as to solve the problems in the related art, and an object of the present disclosure is to provide a method for controlling a hydraulic system of construction machinery, which enables an engine speed (rpm) to maintain a rated engine speed when a high load is sharply required by variably applying the rated engine speed which sets the engine speed.

A technical object to be achieved in the present disclosure is not limited to the aforementioned technical objects, and another not-mentioned technical object will be obviously understood from the description below by those with ordinary skill in the art to which the present disclosure pertains.

In order to achieve the technical object, an exemplary embodiment of the present disclosure provides a method for controlling a hydraulic system of construction machinery, including: a maximum value setting step S130, in which when a required torque value for a pump is generated, the required torque value is set to a maximum value; a power conversion step S140, in which a power value matched to a current load mode and the maximum value is output; an inclination limit step S150, in which an inclination of time until the power value is implemented is limited; an engine speed (rpm) prediction step S160, in which a virtual engine speed to be input later is predicted by using a digital filter by receiving an actual engine speed from an engine control device 20, and a value of the engine speed predicted before the actual engine speed is output; a PID control step S170, in which proportional integral derivative (PID) control is performed so that the actual engine speed converges the virtual engine speed; and a final power output step S190, in which the pump is controlled by outputting a final power value obtained by adding a first power value determined by the load mode, a second power value determined by the required value, and a third power value deduced by the PID control, in which a rated engine speed according to the load mode is a variable rated engine speed varied within range larger than a fixed rated engine speed and smaller than a high idle engine speed for the fixed rated engine speed.

In the method for controlling the hydraulic system of construction machinery according to the present disclosure, an initial value of the variable rated engine speed may be controlled to be larger than the fixed rated engine speed by 70 rpm to 95 rpm.

The method for controlling the hydraulic system of construction machinery according to the present disclosure may further include a saturation prevention step S180, in which a value of a control width I of the actual engine rpm during the process of converging the actual engine speed to the virtual engine speed in the PID control step S170 is limited not to deviate from a predetermined upper limit and lower limit.

Other detailed matters of the exemplary embodiments are included in the detailed description and the drawings.

The method for controlling the hydraulic system of construction machinery according to the present disclosure, which is configured as described above, may prevent an engine speed from being decreased to a rated engine speed or less when a high load is sharply required by varying and applying the rated engine speed.

Further, the method for controlling the hydraulic system of construction machinery according to the present disclosure may prevent excessive fuel consumption and improve fuel efficiency by appropriately maintaining an engine speed.

DETAILED DESCRIPTION

Figure 1:
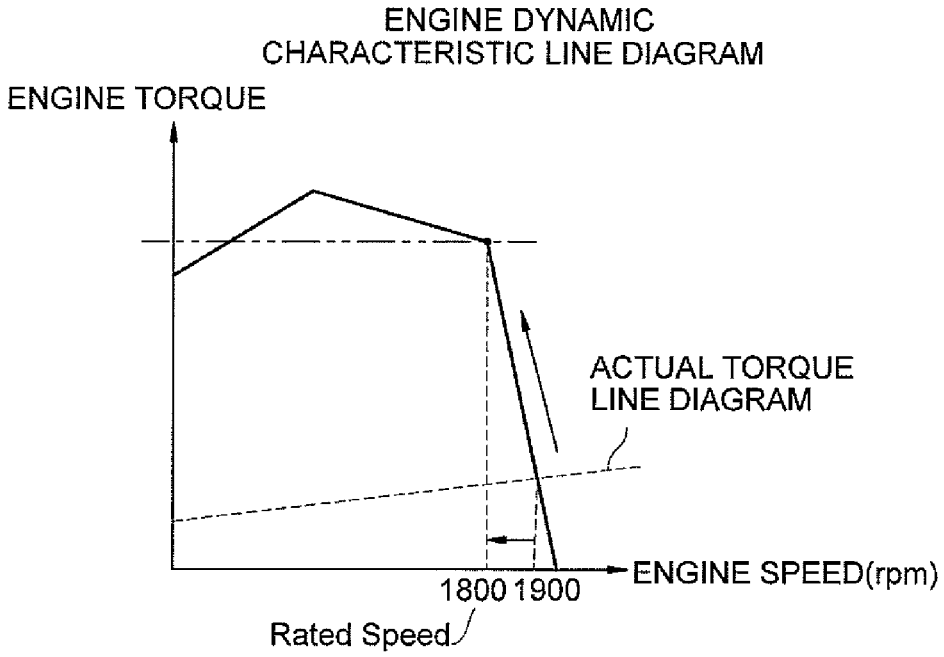
FIG. 1 (Prior Art)
FIG. 1 is a line diagram of an engine dynamic characteristic for describing an engine dynamic characteristic.
Figure 2:
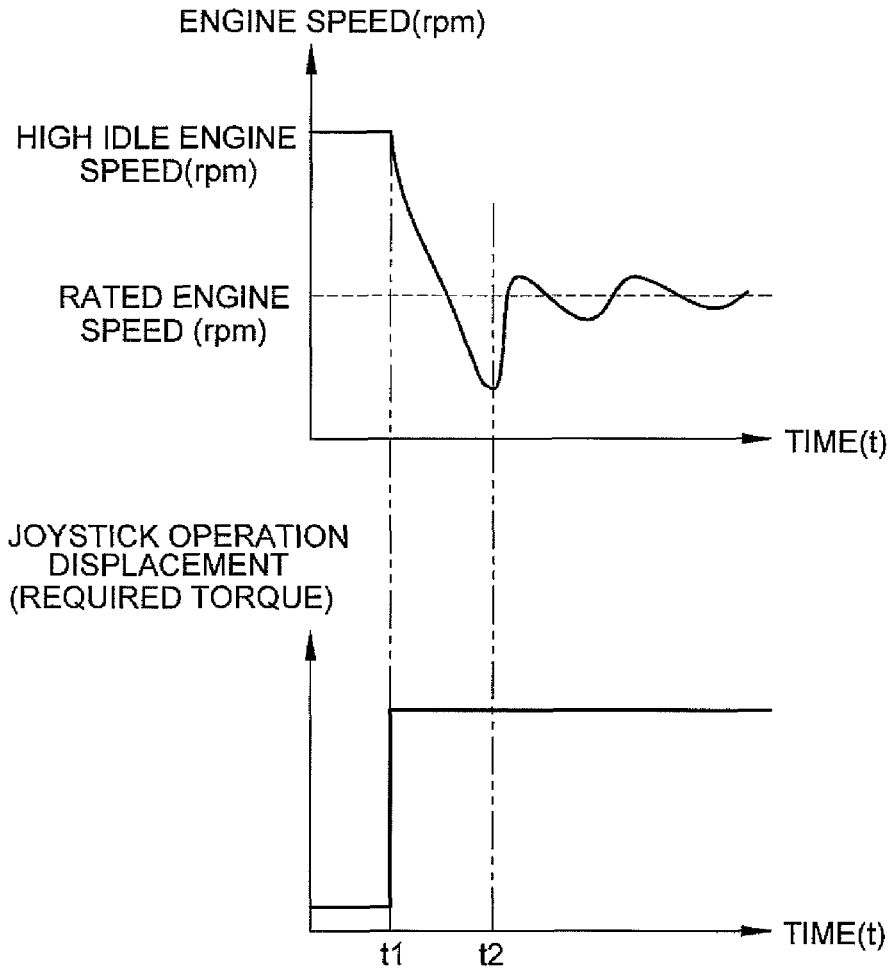
FIG. 2 (Prior Art)
FIG. 2 is a diagram for describing a decrease of engine speed (rpm) in a hydraulic system of construction machinery in the related art.

Advantages and characteristics of the present disclosure, and a method of achieving the advantages and characteristics will be clear with reference to an exemplary embodiment described in detail together with the accompanying drawings.

Hereinafter, an exemplary embodiment of the present disclosure will be described in detail with reference to the accompanying drawings. It should be appreciated that the exemplary embodiment, which will be described below, is illustratively described for helping the understanding of the present disclosure, and the present disclosure may be variously modified to be carried out differently from the exemplary embodiment described herein. In the following description of the present disclosure, a detailed description and a detailed illustration of publicly known functions or constituent elements incorporated herein will be omitted when it is determined that the detailed description may make the subject matter of the present disclosure unclear. Further, the accompanying drawings are not illustrated according to an actual scale, but sizes of some constituent elements may be exaggerated for helping understanding of the present disclosure.

Further, the terms used in the description are defined considering the functions of the present disclosure and may vary depending on the intention or usual practice of a manufacturer. Therefore, the definitions should be made based on the entire contents of the present specification.

Like reference numerals indicate like constituent elements throughout the specification.

Figure 3:
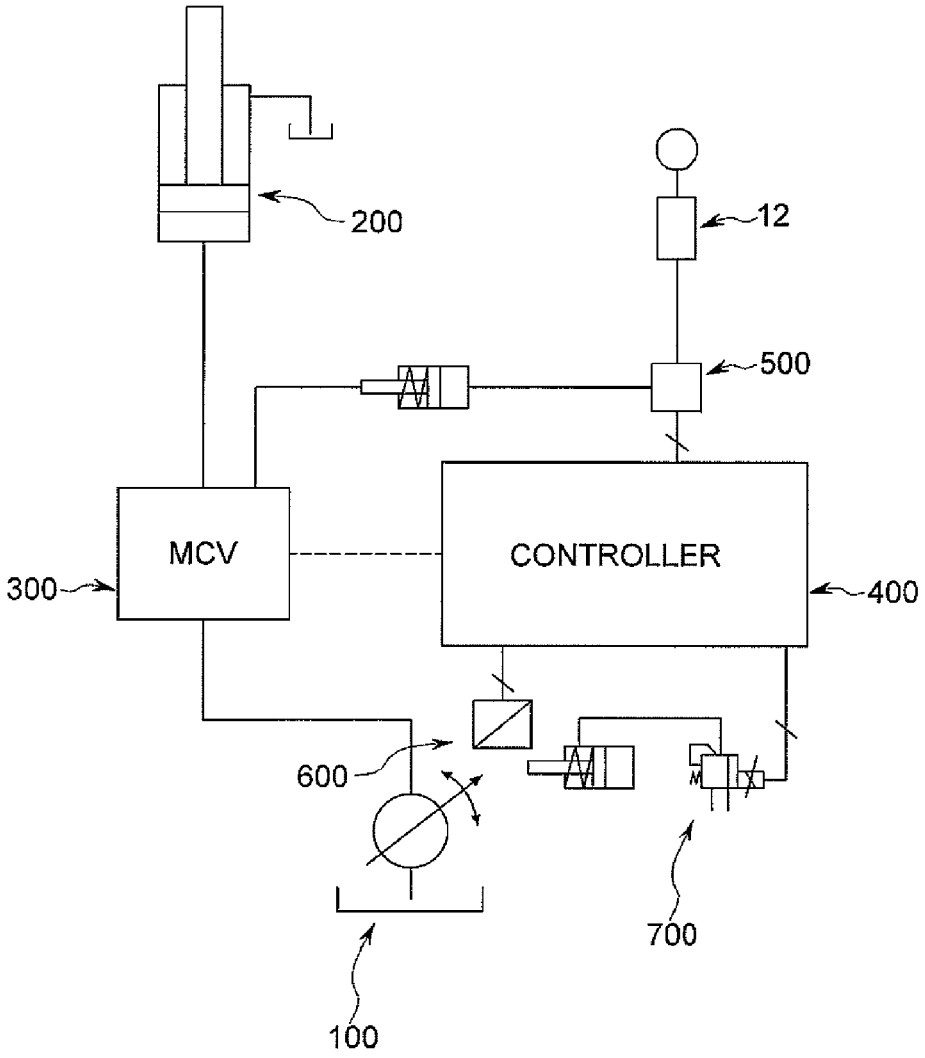
FIG. 3 is a hydraulic circuit diagram illustrating a hydraulic system of construction machinery according to an exemplary embodiment of the present disclosure.

FIG. 3 is a hydraulic circuit diagram illustrating a hydraulic system of construction machinery according to an exemplary embodiment of the present disclosure. A detailed configuration and function of the hydraulic system of construction machinery will be described in detail with reference to FIG. 3.

FIG. 3 illustrates the hydraulic system of construction machinery, which includes a closed center-type main control valve and a pressure control-type hydraulic pump to control a flow rate and pressure and implement free load feeling when operating the construction machinery, and the hydraulic system of construction machinery includes a hydraulic pump 100, an actuator 200, a main control valve 300, a controller 400, a pressure sensor 500, an angle sensor 600, and an electronic proportional pressure reducing valve (EPPR valve) 700.

The hydraulic pump 100 is driven by an engine (not illustrated) that is a driving source of construction machinery, and a plurality of hydraulic pumps is provided as pressure control-type electronic pumps. Accordingly, flexibility is excellent in a process of discharging working oil.

The actuator 200 is driven by working oil discharged from the hydraulic pump 100, and for example, may be provided as a hydraulic cylinder or a hydraulic motor.

The main control valve 300 is provided in a closed center type between the hydraulic pump 100 and the actuator 200, and bypasses, that is, bleeds off, a virtual flow rate when the actuator 200 is operated.

Particularly, the main control valve 300 is provided in the closed center type, so that a surplus flow rate and pressure are not lost, thereby improving fuel efficiency and the like of the construction machinery, and the main control valve 300 bypasses a virtual flow rate to freely generate load feeling generated in an open center-type main control valve.

The controller 400 receives the virtual flow rate bypassed from the main control valve 300 to control the hydraulic pump 100.

That is, the controller 400 receives pressure of the operating unit 12 and a swash plate angle of the hydraulic pump 100 and outputs a current instruction according to the received pressure and swash plate angle to the EPPR valve 700, and the EPPR valve 700 controls the swash plate angle so as to control the pressure of the hydraulic pump 100 to be proportional to the current instruction.

Here, the pressure sensor 500 detects pressure applied to the plurality of operating units 12, that is, the joystick or the pedal, provided at the construction machinery and inputs the detected pressure into the controller 400, and the angle sensor 600 detects a swash plate angle of the hydraulic pump 100 and inputs the detected swash plate angle into the controller 400.

In the meantime, according to the exemplary embodiment of the present disclosure, in order to decrease a distribution ratio of engine horsepower at a pump, in which a horsepower margin is generated, among the plurality of pressure control-type hydraulic pumps 100 and to increase a distribution ratio of engine horsepower at a pump, to which a relatively heavy load is applied, the controller 400 separately controls the plurality of hydraulic pumps 100 according to an operation mode of the construction machinery.

That is, the controller 400 distributes a maximum horsepower valve provided from the engine (not illustrated) to each of the hydraulic pumps 100 according to a distribution ratio predetermined for each operation mode of the construction machinery.

When the hydraulic pumps 100 include a first pump 110 and a second pump 120, examples of the operation modes of the construction machinery are represented in Table 1 below, and the distribution ratio according to each operation mode is a value suggested for helping understanding of the present disclosure and does not limit the scope of the present disclosure.

TABLE 1

| Operation | First pump (%) | Second pump (%) |
|---|---|---|
| Boom Up | 55 | 45 |
| Boom Down | 50 | 50 |
| Bucket Crowd | 50 | 50 |
| Bucket Dump | 50 | 50 |
| Arm Crowd | 40 | 60 |
| Arm Dump | 45 | 55 |
| Swing | 70 | 30 |
| Boom Up + Bucket | 55 | 45 |
| Boom Down + Bucket | 50 | 50 |
| Arm Crowd + Swing | 50 | 50 |
| Arm Dump + Swing | 30 | 70 |
| Boom Up + Arm | 50 | 50 |
| Boom Up + Swing | 70 | 30 |
| Bucket + Arm | 50 | 50 |
| Bucket + Swing | 70 | 30 |
| Three complex operations + Swing | 70 | 30 |

In this case, a specific hydraulic pump among the hydraulic pumps 100 may be allocated as the first pump 100 under two references.

First, the first pump 110 and the second pump 120 are allocated according to an operation quantity of the operating unit 12 of an operating device, such as a boom, an arm, and a bucket. Particularly, the controller 400 detects operation quantities from the plurality of operating units 12, that is, the joystick and the pedal, allocated to the first pump 110 and the second pump 120, respectively, sums the detected operation quantities for each first pump 110 and second pump 120, and allocates the pump having the larger summed operation quantity as the first pump 110.

Second, the first pump 110 and the second pump 120 are allocated according to a load applied during an operation. Particularly, the controller 400 allocates a pump having larger load pressure during an operation between the first pump 110 and the second pump 120 as the first pump 110.

In the meantime, according to the distribution ratio according to the operation mode of the construction machinery represented in Table 1, horsepower of the engine is distributed to the first pump 110 and the second pump 120 according to a distribution ratio of a corresponding operation mode, and a process of setting an initial flow rate of the first pump 110 and the second pump 120 will be described based on a case where the construction machinery simultaneously performs a boom-up operation and a swing operation as an example.

When the construction machinery simultaneously performs the boom-up operation and the swing operation, 70% of horsepower of the engine is distributed to the first pump 110, and 30% of horsepower of the engine is distributed to the second pump 120, as shown in Table 1.

When the second pump 120 does not use all of 30% of the horsepower of the engine, but uses about 20% of the horsepower of the engine as actual horsepower, it is possible to recognize an actual discharged quantity of working oil currently discharged from the second pump 120 by a load, that is, pressure, applied to an operating device from the outside. That is, the actual discharged quantity of the second pump 120 is calculated by dividing horsepower by applied pressure (Q=horsepower/pressure), and a swash plate angle in this case is detected by the angle sensor 600.

In this case, 10% of the horsepower of the engine, that is the horsepower margin of the second pump 120, is added to 70% of the initially set horsepower of the engine, so that the first pump 110 may use 80% of the horsepower of the engine. Accordingly, when 80% of the horsepower of the engine is divided by the actual discharged flow rate of the first pump 110, it is possible to calculate discharged pressure of the first pump 110, and a pressure instruction according to the calculated discharged pressure is output to the controller 400.

As a result, the hydraulic system of construction machinery includes the closed center-type main control valve and the pressure control-type hydraulic pump, so that it is possible to prevent flow rate loss and pressure loss and implement free load feeling.

Hereinafter, a process of distributing horsepower of the engine according to an operation mode of the hydraulic system of construction machinery will be described in detail with reference to FIGS. 4 to 15.

Figure 4:
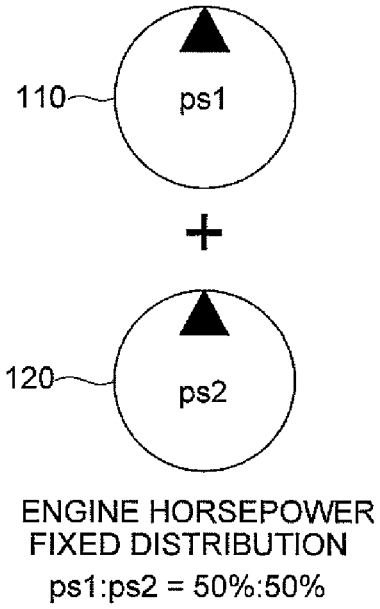
FIGS. 4 to 6 are schematic diagrams for describing an example of distributing horsepower of an engine to a first pump and a second pump in the hydraulic system of construction machinery according to the exemplary embodiment of the present disclosure.
Figure 5:
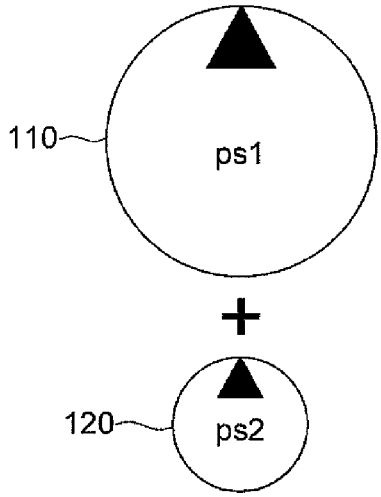
Figure 6:
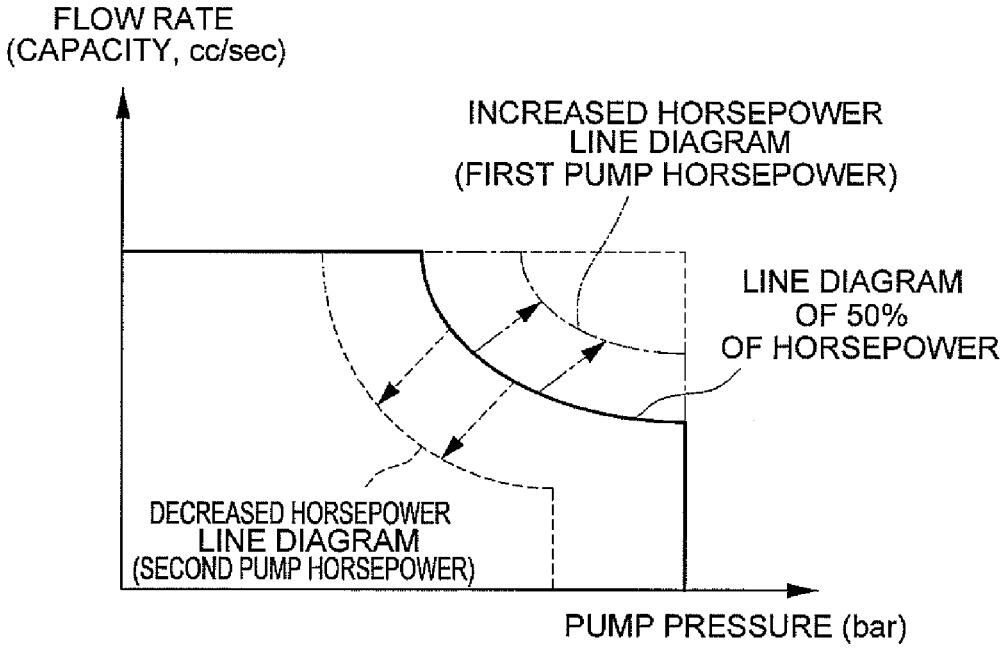

FIGS. 4 to 6 are schematic diagrams for describing an example of distributing horsepower of the engine to the first pump 110 and the second pump 120 in the hydraulic system of construction machinery according to the exemplary embodiment of the present disclosure, and referring to FIG. 4, it can be seen that first horsepower ps1 of the first pump 110 is the same as second horsepower ps2 of the second pump 20. The reason is that the horsepower of the engine is fixedly distributed by 50%:50%.

By contrast, referring to FIG. 5, it can be seen that the first horsepower ps1 of the first pump 110 and the second horsepower ps2 of the second pump 20 are variably distributed according to a distribution ratio x.

That is, as illustrated in FIG. 6, it can be seen that when the horsepower of the engine is distributed to the first pump 110 and the second pump 120 according to the distribution ratio x according to an operation mode of the construction machinery, for example, when the horsepower of the engine is weighted and distributed to the first pump 110 and relatively small horsepower of the engine is distributed to the second pump 120, the first horsepower ps1 of the first pump 110 is increased and the second horsepower ps2 of the second pump 120 is decreased based on a line diagram of 50% of the horsepower.

As a result, in distributing the horsepower of the engine to the first pump 110 and the second pump 120, a distribution ratio is differently set according to an operation mode of the construction machinery and a load applied to the working device, so that it is possible to decrease a distribution ratio of the horsepower of the engine for a pump having a horsepower margin, and increase a distribution ratio of the horsepower of the engine for a pump, to which a relatively heavy load is applied.

Accordingly, it is possible to use all of the horsepower of the engine provided from the engine to the first pump 110 and the second pump 120 without waste, thereby improving fuel efficiency of the construction machinery.

Figure 7:
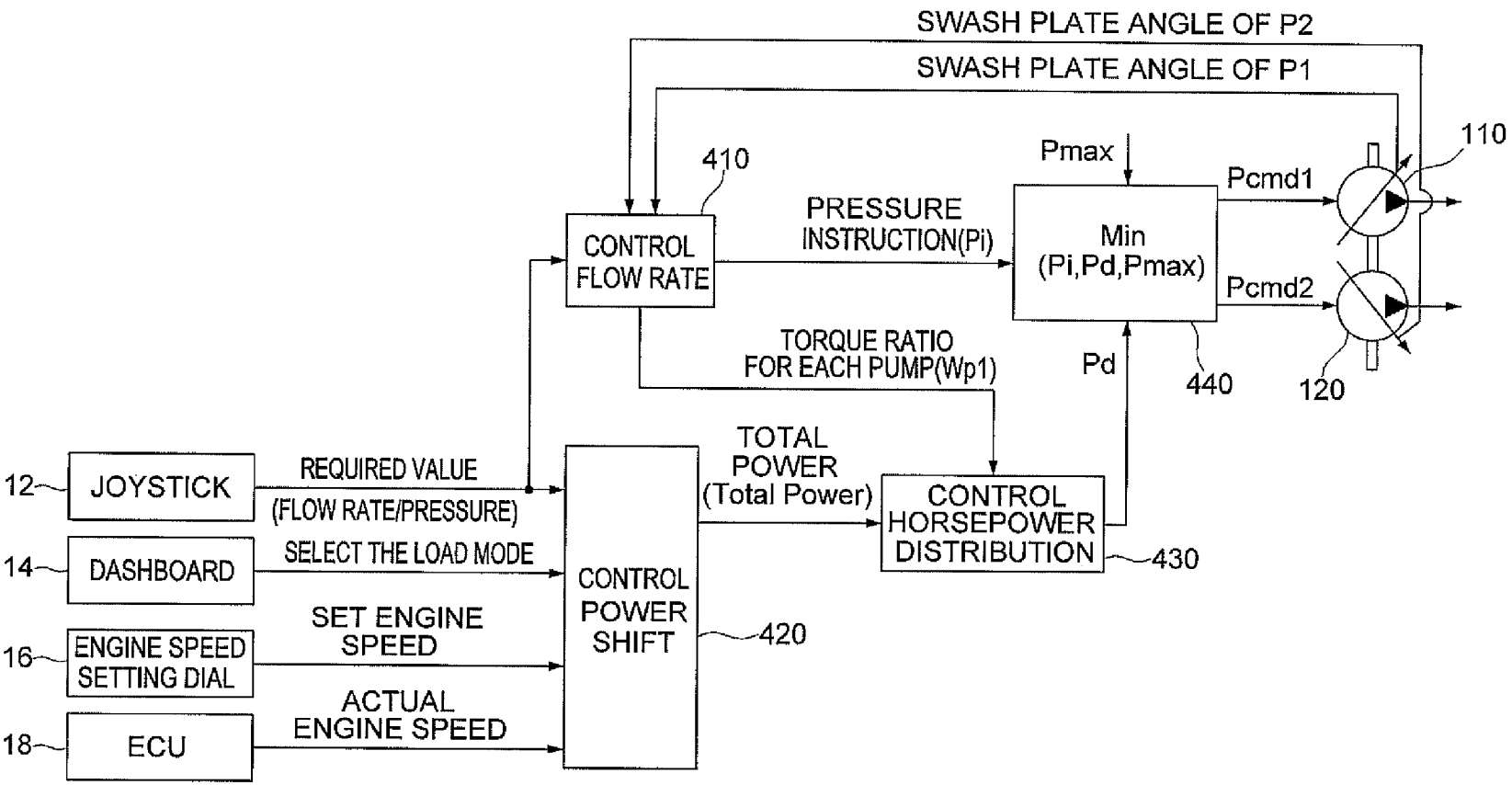
FIG. 7 is a configuration diagram illustrating the hydraulic system of construction machinery according to the exemplary embodiment of the present disclosure.
Figure 8:
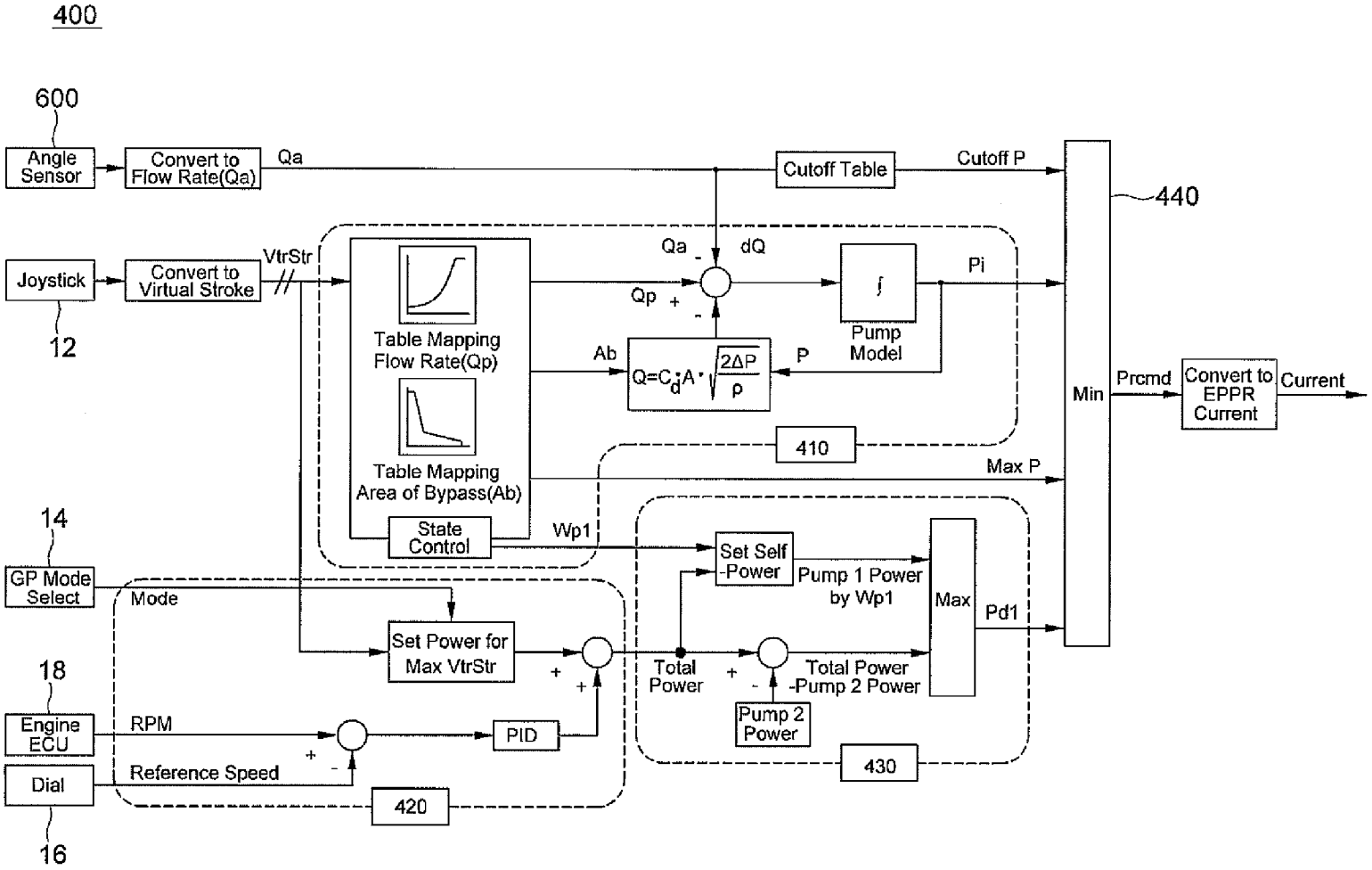
FIG. 8 is a configuration diagram illustrating a controller of the hydraulic system of construction machinery according to the exemplary embodiment of the present disclosure.
Figure 9:
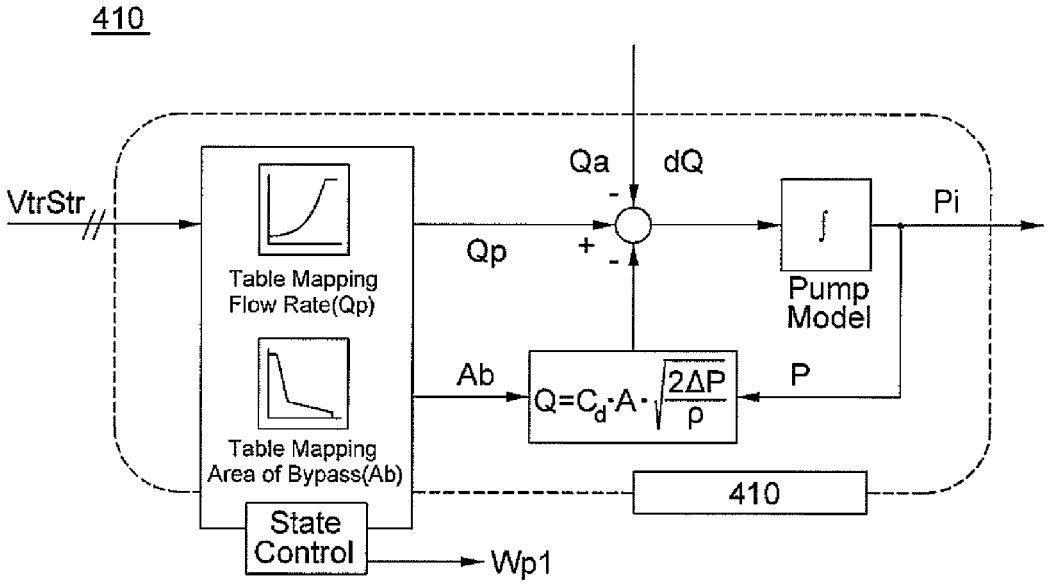
FIG. 9 is a configuration diagram illustrating a flow rate controller of the hydraulic system of construction machinery according to the exemplary embodiment of the present disclosure.
Figure 10:
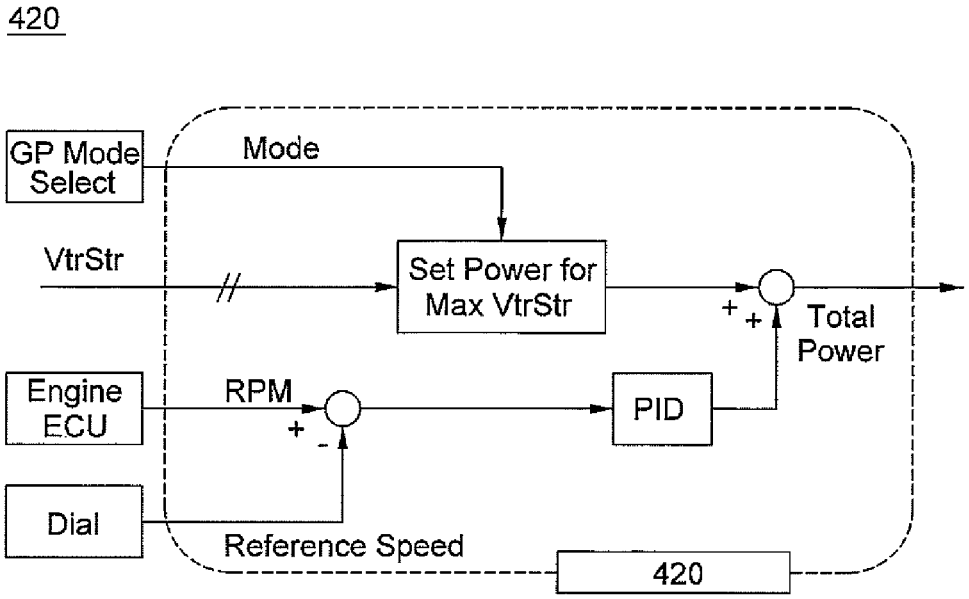
FIG. 10 is a configuration diagram illustrating a power shift controller of the hydraulic system of construction machinery according to the exemplary embodiment of the present disclosure.
Figure 11:
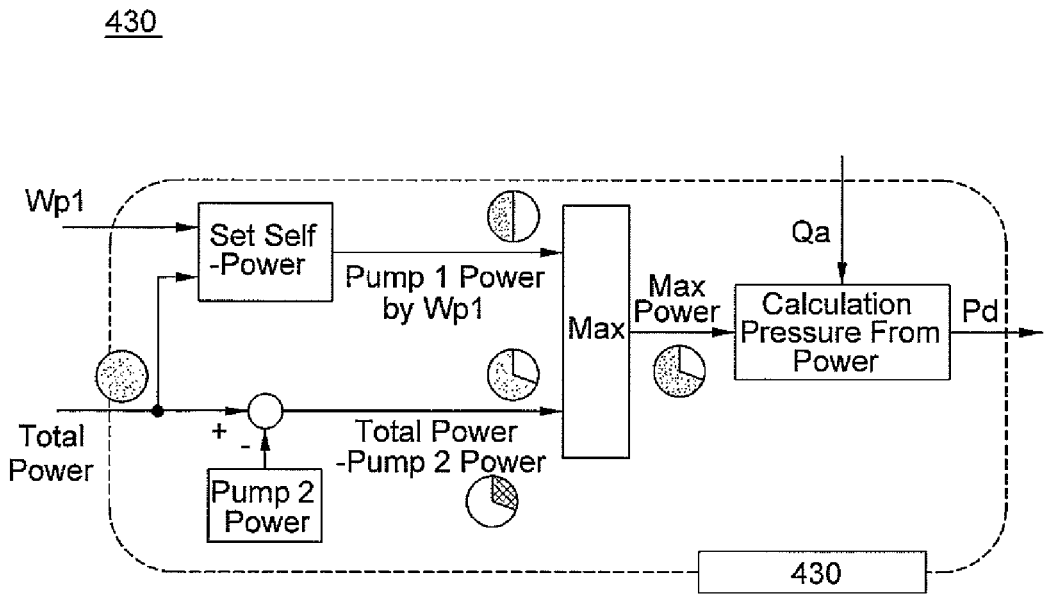
FIG. 11 is a configuration diagram illustrating a horsepower distribution controller of the hydraulic system of construction machinery according to the exemplary embodiment of the present disclosure.

FIG. 7 is a configuration diagram illustrating the hydraulic system of construction machinery according to the exemplary embodiment of the present disclosure, FIG. 8 is a configuration diagram illustrating a controller of the hydraulic system of construction machinery according to the exemplary embodiment of the present disclosure, and FIGS. 9 to 11 are configuration diagrams illustrating a flow rate controller, a power shift controller, and a horsepower distribution controller of the hydraulic system of construction machinery according to the exemplary embodiment of the present disclosure.

Referring to FIGS. 7 and 8, the controller 400 includes a flow rate controller 410, a power shift controller 420, a horsepower distribution controller 430, and a pump controller 440.

The flow rate controller 410 compares flow rates of working oil discharged from the first pump 110 and the second pump 120 with flow rates of working oil required by the plurality of operating units 12, and calculates a torque ratio wp1 provided to each of the first pump 110 and the second pump 120.

Particularly, the flow rate controller 410 receives a swash plate angle from the angle sensor 600 detecting swash plate angles of the first pump 110 and the second pump 120, and calculates a discharged flow rate of the working oil of each of the first pump 110 and the second pump 120.

Further, the operating unit 12 includes the joystick or the pedal as described above, and for example, when the joystick is operated with a maximum displacement, a required signal for a required value (flow rate or pressure) is generated, and the required signal is provided to the flow rate controller 410. The required signal means a size of torque implemented by the first pump 110 and the second pump 120.

The flow rate controller 410 calculates a degree of torque to be required in each hydraulic pump 110 by adding or subtracting a flow rate according to the required signal input from the operating unit 12 to or from the flow rates of the working oil currently discharged from the first pump 110 and the second pump 120, and divides the calculated torque by a torque ratio wp1 for the first pump 110 and the second pump 120 each and provides the divided torque to the horsepower distribution controller 430.

In the meantime, a process of calculating a pressure instruction Pi generated by the flow rate controller 410 will be described with reference to FIG. 9. First, the pressure sensor 500 detects pressure of the operating unit 12 and calculates a required flow rate $Q_p$ of each spool configuring the main control valve 300 and a bypass area $A_b$ of the main control valve 300.

Further, the pressure sensor 500 calculates a bypass flow rate $Q_b$ by using the calculated bypass area $A_b$ and a current pressure instruction P, and subtracts the bypass flow rate $Q_b$ and an actual discharged flow rate $Q_a$, which is calculated by the angle sensor 600, from the required flow rate $Q_p$ to calculate a required flow rate increase or decrease dQ.

$$dQ=Qp-Qb-Qa \quad \text{[Equation 1]}$$

When the required flow rate increase or decrease dQ is calculated, the pressure instruction Pi of each hydraulic pump 100 is calculated from the calculated required flow rate increase or decrease dQ.

Referring back to FIGS. 7 and 8, the power shift controller 420 receives information from the operating unit 12, a load mode selectin unit 14, an engine speed setting unit 16, and an engine control unit (ECU) 18, calculates total power of torque required by the hydraulic pumps 100, and provides the calculated total power to the horsepower distribution controller 430.

Here, the load mode selecting unit 14 select a load mode according to heaviness and lightness of an operation desired to be performed by an operator, and for example, selects a load mode on a dashboard, and may select any one load mode among an excessively heavy load mode, a heavy load mode, a standard load mode, a light load mode, and idle mode. When a higher load mode is selected, high pressure is formed in working oil discharged from the hydraulic pump 100, and when a lower load mode is selected, a flow rate of working oil discharged from the hydraulic pump 100 is increased.

The engine speed setting unit 16 enables a manager to arbitrarily select a speed of the engine, and for example, an operator may set a desired engine speed by adjusting an engine speed dial. When an engine speed is set to be large, the engine may provide larger power to the hydraulic pump 100, but there is a concern in that fuel consumption may relatively increase and durability of the construction machinery may deteriorate, so that it is preferable to set an appropriate engine speed. In a case of the standard load mode, an engine speed may be set to about 1,400 rpm, and may also be set to be larger or smaller according to a tendency of an operator.

The engine control unit 18 is a device controlling the engine, and provides information on an actual engine speed to the power shift controller 420.

In the meantime, a process of calculating total power of torque by the power shift controller 420 will be described with reference to FIG. 10. First, the power shift controller 420 calculates power by selecting a maximum value among lever pressure VtrStr of the plurality of operating units 12, performs proportional integral derivative (PID) control by subtracting an engine speed set in the engine speed setting unit 16 from an actual engine speed of the engine control unit 18, and then calculates total power of torque by adding initial power of the engine, the power set by the operating unit 12, and the PID control value.

Referring back to FIGS. 7 and 8, the horsepower distribution controller 430 calculates torque charged by each of the first pump 110 and the second pump 120 according to the torque ratio wp1 calculated by the flow rate controller 410 and the total power of the torque calculate by the power shift controller 420.

A process of calculating a pressure instruction $P_d$ of each of the hydraulic pumps 100 by the horsepower distribution controller 430 will be described with reference to FIG. 11. First, the horsepower distribution controller 430 divides the calculated total power of torque calculated by the power shift controller 420 by the torque ratio wp1 calculated by the flow rate controller 410 and calculates maximum power usable by the first pump 110.

Further, the horsepower distribution controller 430 calculates power of the second pump 120 by using the angle sensor 600 of the second pump 120 and the pressure instruction, and subtracts the calculated power from the total power of torque, and determines a larger value between the maximum power usable by the first pump 110 and the value obtained by subtracting the power of the second pump 120 from the total power of torque as maximum power.

The determined maximum power is divided by the actual discharged flow rate $Q_a$ to calculate the pressure instruction $P_d$ for controlling horsepower.

Referring back to FIGS. 7 and 8, the pump controller 440 selects the smallest value among the pressure instruction Pi generated by the flow rate controller 410, the pressure instruction $P_d$ calculated by the horsepower distribution controller 430, and a maximum pump pressure value $P_{max}$ maximally applied to the operating unit 12, outputs the selected smallest value as a pressure instruction value of the first pump 110 and the second pump 120, converts the pressure instruction value into a current instruction, and then transmits the converted current instruction to the EPPR valve 700.

Figure 12:
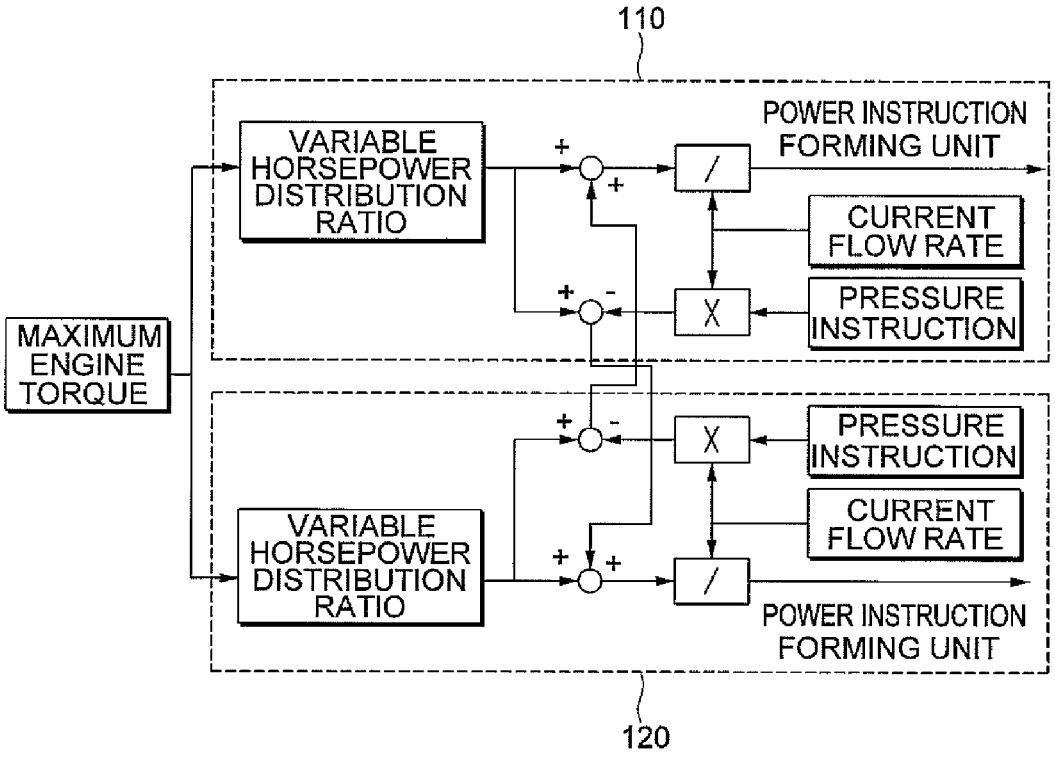
FIG. 12 is a configuration diagram illustrating an example of distribution of horsepower of the engine in the hydraulic system of construction machinery according to the exemplary embodiment of the present disclosure.

FIG. 12 is a configuration diagram illustrating an example of distribution of horsepower of the engine in the hydraulic system of construction machinery according to the exemplary embodiment of the present disclosure, and referring to FIG. 11, engine torque is optimally distributed to a pump, which has larger horsepower consumption because a large load is applied to the pump or an operation quantity thereof is large, by allocating a variable horsepower distribution ratio to each of the first pump 110 and the second pump 120 according to a complex operation mode of the construction machinery.

That is, in order to calculate horsepower currently consumed by the first pump 110 and the second pump 120, a horsepower margin by the amount obtained by subtracting power of the first pump 110 and the second pump 120 calculated by using a current flow rate, which is obtained by the swash plate angle information of the hydraulic pump 100 detected by the angle sensor 600 and the controlling pressure instruction from the full horsepower, is used.

Figure 13:
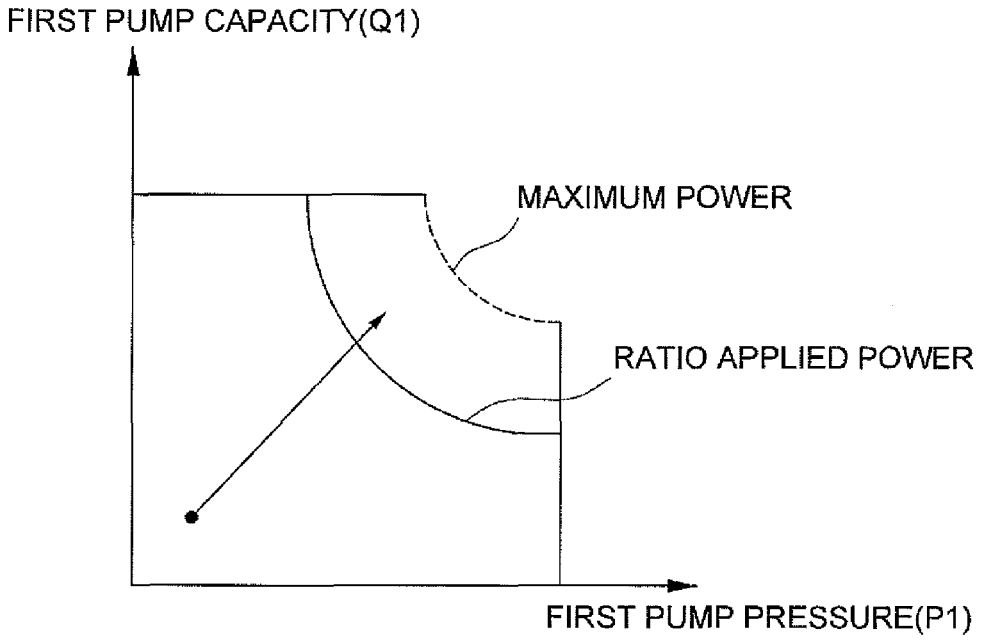
FIGS. 13 to 15 are diagrams illustrating an example, in which power of the engine is distributed to the first pump and the second pump according to a distribution ratio according to FIG. 12.
Figure 14:
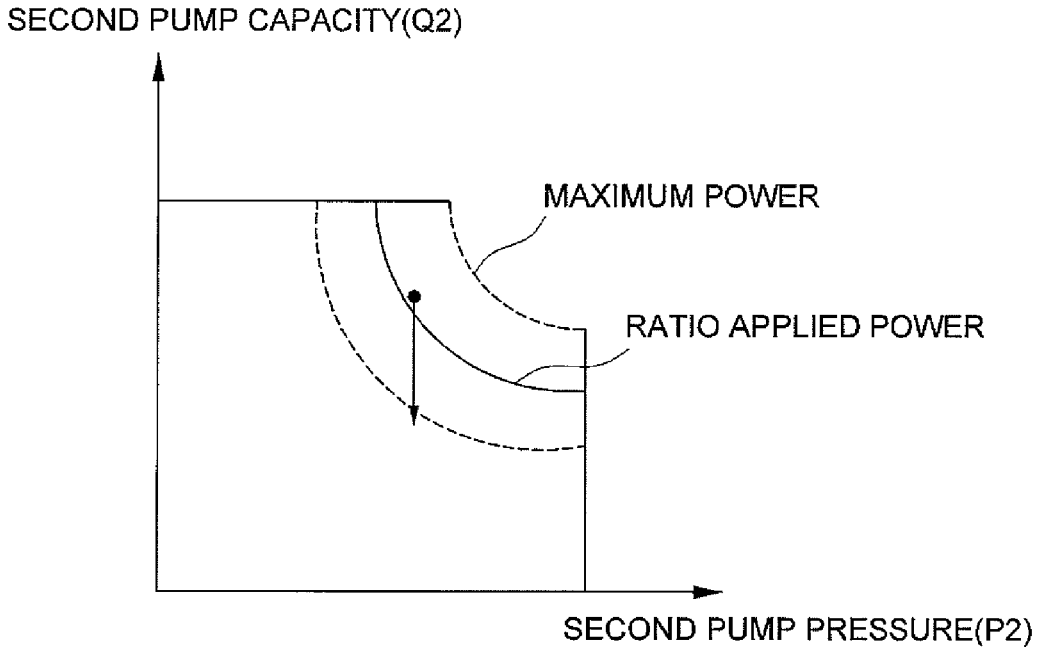
Figure 15:
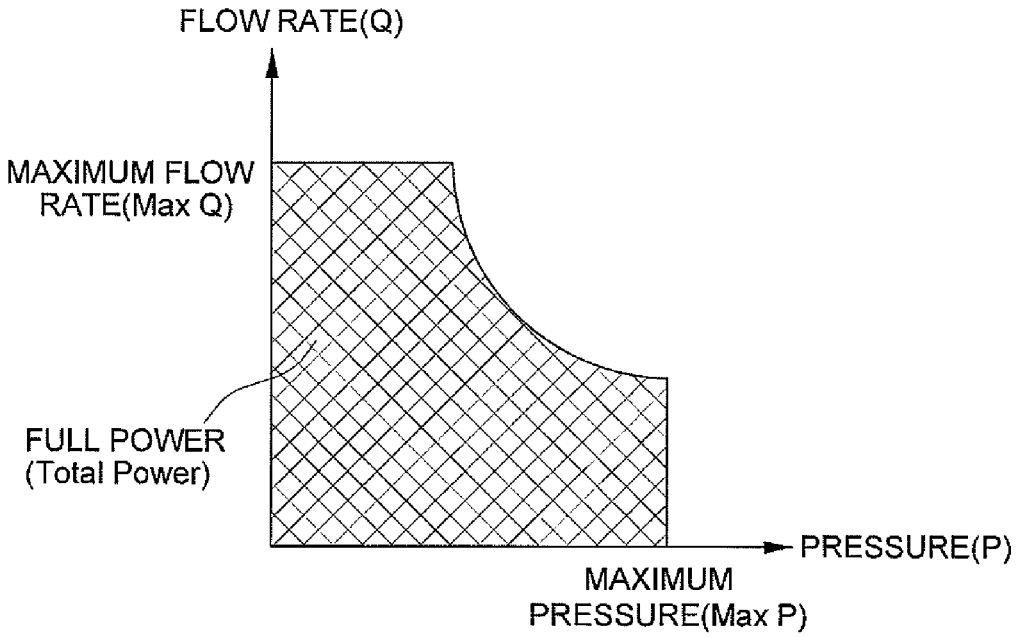

FIGS. 13 to 15 are diagrams illustrating an example, in which power of the engine is distributed to the first pump and the second pump according to a distribution ratio according to FIG. 12, and FIG. 13 is a graph illustrating a power line diagram of the first pump 110.

Pump horsepower (or pump power) is calculated by multiplying the pressure P1 and a capacity Q1 of the first pump 110, and occupies an area by power obtained by applying a distribution ratio to maximum power (horsepower) in the first pump 110. According to the exemplary embodiment of the present disclosure, when it is assumed that a distribution ratio of the first pump 110 is 70% of the engine horsepower, the pump horsepower occupies a large area corresponding to 70%.

FIG. 14 is a graph illustrating a power line diagram of the second pump 120, and pump horsepower (or pump power) is calculated by multiplying the pressure P2 and a capacity Q2 of the second pump 120. Similarly, the pump horsepower occupies an area by power obtained by applying a ratio to maximum power (horsepower) in the second pump 120, and according to the exemplary embodiment of the present disclosure, since it is assumed that a distribution ratio of the second pump 120 is 30% of the engine horsepower, the pump horsepower occupies a small area corresponding to 30%.

In FIG. 15, the entire horsepower obtained by adding the pump horsepower (power) of the first pump 110 and the pump horsepower (power) of the second pump 120 is the same as full horsepower (power) provided to the first pump 110 and the second pump 120 by the engine.

That is, the pumps use all of the available horsepower, so that there is no energy waste.

Hereinafter, a method for controlling the hydraulic system of construction machinery according to the exemplary embodiment of the present disclosure will be described with reference to FIG. 16.

Figure 16:
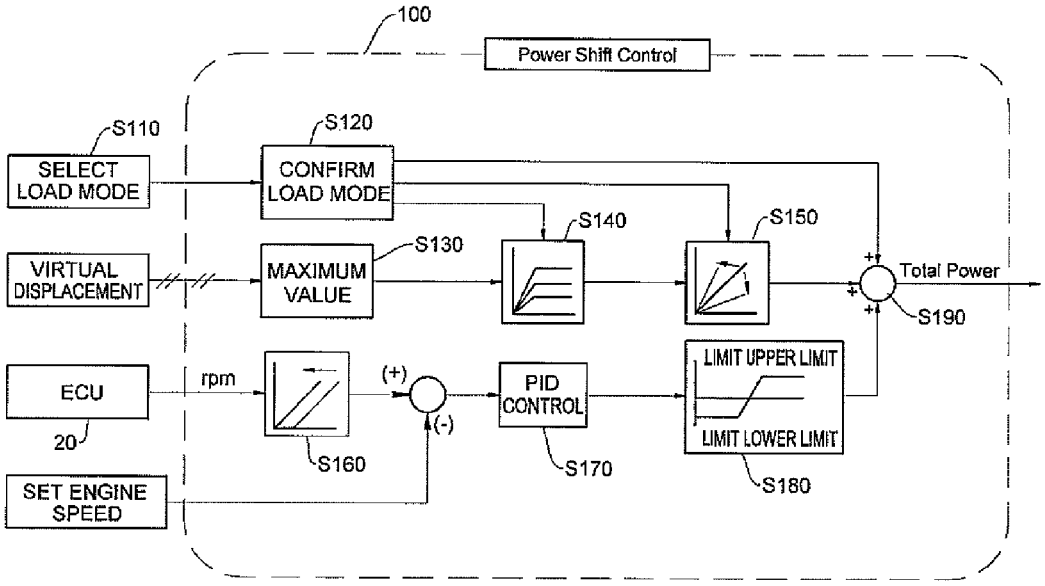
FIG. 16 is a diagram for describing an example of a method for controlling the hydraulic system of construction machinery according to the exemplary embodiment of the present disclosure.

FIG. 16 is a diagram for describing an example of a method for controlling the hydraulic system of construction machinery according to the exemplary embodiment of the present disclosure.

A virtual bleed off (VBO) electronic pump is used in the hydraulic system according to the exemplary embodiment of the present disclosure. Further, the hydraulic system according to the exemplary embodiment of the present disclosure uses a variable rated engine speed for a joystick input (joystick displacement quantity) to improve a drop phenomenon of an engine speed when an operation, in which a sharp load is generated, is performed by adjusting an allowable horsepower inclination with a logic, which optimally controls the variable rated engine speed by reflecting a dynamical characteristic of the engine for each model/mode by using a control means.

Hereinafter, horsepower control 100 according to the exemplary embodiment of the present disclosure will be described.

Load mode selection step S110: First, an operator selects a load mode in a load mode selection step S110. The load mode may be divided into an excessively heavy load, a heavy load, a standard load, and a light load. That is, the operator selects a load mode according to an expected size of an operation load.

Load mode confirmation step S120: Then, when the load mode is selected in the load mode selection step S110, the load mode is confirmed. A load mode ratio, an inclination weighted value, maximum power, and the like are differently set according to the load mode, and the setting is based on the load mode.

Maximum value setting step S130: Further, when the operator operates the joystick, a displacement is generated. The joystick displacement may be understood as a pump torque value required by the operator. The operation of the joystick is input as a virtual displacement, so that a maximum value is selected.

Power conversion step S140: Then, in a power conversion step S140, a power value matched to the maximum value of the joystick displacement and a map of the load selected in the load mode confirmation step S120 is calculated.

In this case, a use ratio of full power transmitted to the engine 10 is determined according to the load mode. For example, in the excessively heavy load mode, a use ratio may be set to 100% of full power transmitted to the engine, and in the heavy load mode, a use ratio may be set to 95% of full power transmitted from the engine. That is, a power value proportional to the displacement quantity of the joystick is determined and output by reflecting the load mode.

Inclination limit step S150: Then, a maximum power increase inclination is limited in an inclination limit step S150. To additionally describe, the inclination implements the power value set in the power conversion step S140 and may be understood as a value by which power to time is implemented. When a size of the load set in the load mode is large, a sharp inclination is set, and when a size of the load set in the load mode is comparatively small, a gentle inclination is set. That is, the inclination indicates a time period for which a required power value is implemented.

Engine speed prediction step S160: Actual engine speed information is input from the engine control device 20 in an engine speed prediction step S160. In the engine speed prediction step S160, an engine speed to be input later is predicted based on a previously input engine speed by using a digital lead filter, and a virtual engine speed value predicted is output before an engine speed is actually input. That is, the actual engine speed and the virtual engine speed have the equal value, but have a time difference.

In the meantime, the operator sets a target engine speed by operating a dial 40 in advance.

PID control step S170: PID control is performed so that the actual engine speed converges the virtual engine speed in the PID control step S170. When it is assumed that the target engine speed is set to, for example, 1,800 rpm, an operation actually starts at an idle engine speed of 1,900 rpm. Then, the engine speed is gradually decreased by a hydraulic load. When the engine speed is lower than the target engine speed, the actual engine speed is controlled to recover the target engine speed by decreasing the amount of use of the hydraulic load.

The PID control step S170 will be described in more detail. An error value, at which the actual engine speed value deviates from the virtual engine speed value, is generated. The error value may be represented by a positive (+) value and a negative (−) value. A positive error value indicates a case where the actual engine speed value is larger than the virtual engine speed value, and a negative error value indicates a case where the actual engine speed value is smaller than the virtual engine speed value. The PID control is performed so that the actual engine speed value converges the target value while decreasing a deviation of the error value.

Saturation prevention step S180: then, a saturation prevention step S180 is performed. In the saturation prevention step S180, when the error value generated in a state of performing the PID control step S170 is continuously accumulated, a value of a width I, which is controlled when the error value is controlled from the positive value to the negative value or from the negative value to the positive value is excessively, increased and is in a saturated state, so that PID controllability may deteriorate. In order to prevent the saturation, an operation of preventing the error value from exceeding an upper limit and a lower limit is performed by setting the upper limit and the lower limit of the error value. The saturation prevention step is referred to as an "anti-wind up".

Final power output step S190: Then, a final power output step S190 is performed. In the final power output step S190, a final control value is calculated by adding all of a first power value determined by the load mode, a second power value required by operating the joystick, and a third power value deduced by the ND control.

The final control value is an instruction controlling a pump regulator 50. The pump regulator 50 controls the hydraulic pump. More particularly, the pump regulator 50 controls a swash plate provided in the hydraulic pump, and a swivel angle of the swash plate is changed, and as a result, a flow rate discharged from the hydraulic pump per unit time is changed.

Figure 17:
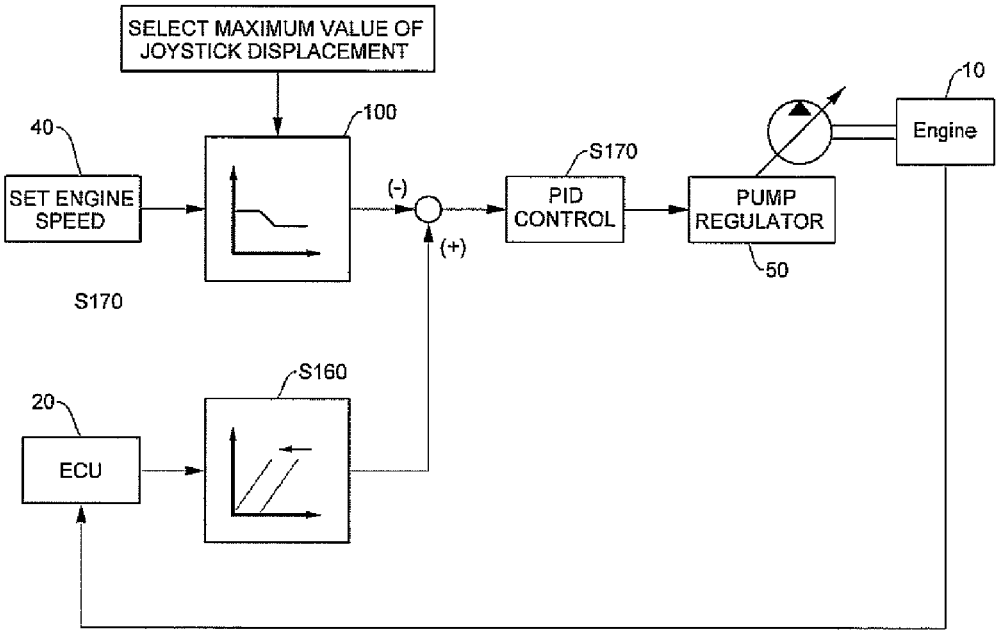
FIG. 17 is a diagram for describing an action of the method for controlling the hydraulic system of construction machinery according to the exemplary embodiment of the present disclosure.
Figure 18:
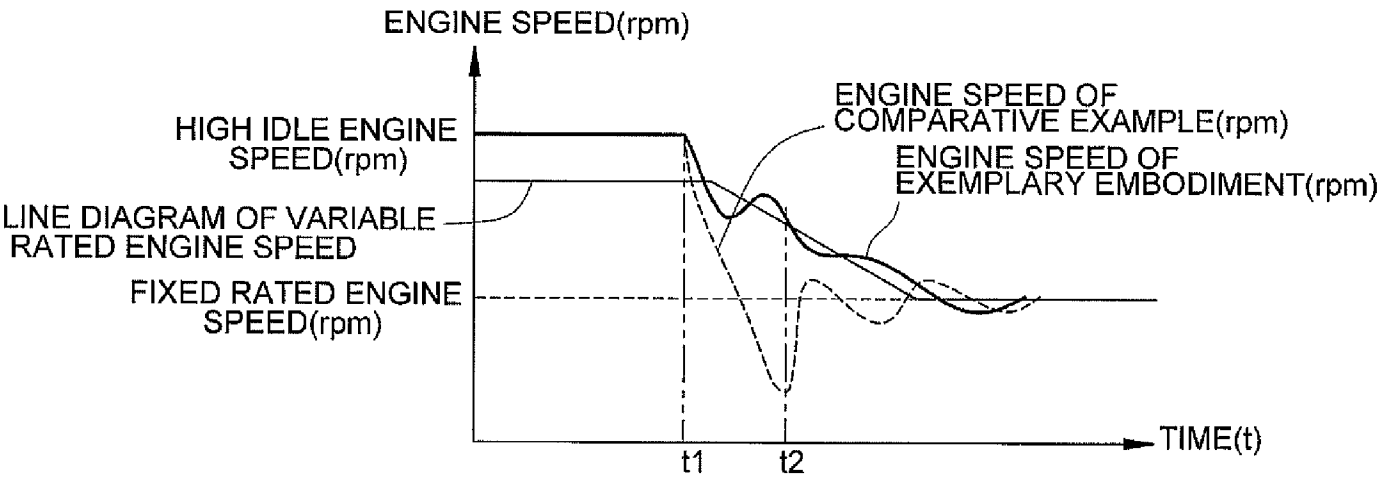
FIG. 18 is a diagram for describing a development of an engine speed controlled by the method for controlling the hydraulic system of construction machinery according to the exemplary embodiment of the present disclosure.

Hereinafter, an operation effect of the hydraulic system according to the exemplary embodiment of the present disclosure will be described with reference to FIGS. 17 and 18. FIG. 17 is a diagram for describing an action of the method for controlling the hydraulic system of construction machinery according to the exemplary embodiment of the present disclosure. FIG. 18 is a diagram for describing a development of an engine speed controlled by the method for controlling the hydraulic system of construction machinery according to the exemplary embodiment of the present disclosure.

An action of the hydraulic system of construction machinery according to the exemplary embodiment of the present disclosure will be described below.

An input target engine speed (reference speed) is set to have a difference gap with an actual engine speed in the hydraulic system in the related art. More particularly, in the hydraulic system in the related art, an engine speed value larger than the target engine speed (reference speed) by 100 rpm is set as high idle, but in the hydraulic system of construction machinery according to the exemplary embodiment of the present disclosure, a rated engine speed may be varied and designated. A variable rated engine speed may be a value between a fixed rated engine speed and a high idle engine speed.

That is, an initial rated engine speed of the hydraulic system according to the exemplary embodiment of the present disclosure is variably set, and for example, the initial rated engine speed may be set as a value larger than the fixed rated engine speed by 70 rpm to 95 rpm. Accordingly, the high idle engine speed in the hydraulic system according to the exemplary embodiment of the present disclosure may also have a larger value than that of the high idle engine speed in the hydraulic system in the related art.

Here, the variable rated engine speed is driven at a high value larger than the fixed rated engine speed by 70 rpm, so that the pump torque may initially have a margin. Further, the variable rated engine speed is driven at a high value larger than the fixed rated engine speed by 90 rpm, so that it is possible to prevent excessive fuel consumption.

Further, in the hydraulic system according to the exemplary embodiment of the present disclosure, when an operation load is applied, the variable rated engine speed is gradually decreased to the fixed rated engine speed while having an inclination. That is, an inclination and a start point of the target engine speed is changed according to a required value generated according to an operation of the joystick to perform control so that a gap between the target engine speed and the actual engine speed is maximally decreased. Here, the start point means a variable rated engine speed, and as illustrated in FIG. 5, the engine is driven at a high engine speed from the start and original torque is large, so that even when an operation load is applied, it is possible to implement torque in at degree accepting the load, so that the engine speed is prevented from being decreased to the actual fixed rated engine speed or lower.

Accordingly, even though the engine speed according to the exemplary embodiment of the present disclosure is gradually decreased according to an increase in an operation load, the engine speed is not sharply decreased to the fixed rated engine speed or lower. That is, the engine speed according to the exemplary embodiment of the present disclosure is gently stable.

That is, the engine speed is tuned by changing an inclination according to an engine speed decrease quantity (RPM drop) according to the dynamic characteristic of the engine. When the dynamic characteristic of the engine is improved, a fuel efficiency improvement effect and a controllability effect are increased.

In the hydraulic system in the related art, when a gap between a high idle engine speed and a target engine speed (reference speed) is large in order to use maximum horsepower of a pump, in a case where a sharp load operation is incurred according to a situation, a dynamic characteristic of an engine fails to follow available horsepower of the pump, so that exhaust gas is generated and controllability is negatively influenced, but the method for controlling the hydraulic system according to the exemplary embodiment of the present disclosure may reduce exhaust gas and improve controllability by improving an engine speed decrease phenomenon.

The exemplary embodiments of the present disclosure have been described with reference to the accompanying drawings, but those skilled in the art will understand that the present disclosure may be implemented in another specific form without changing the technical spirit or an essential feature thereof.

Accordingly, it will be understood that the aforementioned exemplary embodiments are described for illustration in all aspects and are not limited, and the scope of the present disclosure shall be represented by the claims to be described below, and it shall be interpreted that all of the changes or modified forms induced from the meaning and the scope of the claims, and an equivalent concept thereof are included in the scope of the present disclosure.

The method for controlling the hydraulic system of construction machinery according to the exemplary embodiment of the present disclosure may be used for controlling a hydraulic system by applying a variable rated speed according to a dynamic characteristic of an engine.

What is claimed is:

1. A method for controlling a hydraulic system of construction machinery, the method comprising:

a maximum value setting step, in which when a required torque value for a pump is generated, the required torque value is set to a maximum value;

a power conversion step, in which a power value matched to a current load mode and the maximum value is output;

an inclination limit step, in which a conversion speed of the power value per hour is limited;

an engine speed prediction step, in which a virtual engine speed value is predicted based on a previously input engine speed;

a PID control step, in which proportional integral derivative control is performed so that the actual engine speed converges toward the virtual engine speed; and a final power output step, in which the pump is controlled with a final power value obtained by adding a first power value determined by the current load mode, a second power value determined by the required torque value for the pump, and a third power value deduced by the PID control.

2. The method of claim 1, wherein a rated engine speed according to the current load mode is a variable rated engine speed varied within range larger than a fixed rated engine speed and smaller than a high idle engine speed for the fixed rated engine speed.

3. The method of claim 2, wherein an initial value of the variable rated engine speed is controlled to be larger than the fixed rated engine speed by 70 rpm to 95 rpm.

4. The method of claim 1, further comprising:

a saturation prevention step, in which a value of a control width of the actual engine speed during the process of converging the actual engine speed to the virtual engine speed in the PID control step is limited not to deviate from a predetermined upper limit and lower limit.

5. The method of claim 1, wherein in the engine speed prediction step, the virtual engine speed to be input later is predicted by receiving the actual engine speed from the engine control device by using a digital lead filter.

6. The method of claim 1, further comprising:

a load mode selection step, in which an operator selects any one mode among a plurality of load modes divided according to a size of a load; and a load mode confirmation step, in which a load mode ratio, an inclination weighted value, and initial power are set according to the load mode selected in the load mode selection step.

7. The method of claim 1, wherein in the maximum value setting step, the required torque value for the pump is generated according to an operation displacement of a joystick or a pedal.

8. The method of claim 1, wherein in the power conversion step, a use ratio of full power transmitted from the engine is set according to a load map selected by the current load mode.

9. The method of claim 1, wherein in the engine speed prediction step, the virtual engine speed value is predicted by using a digital lead filter.

* * * * *